United States Patent [19]

Crum et al.

[11] 4,230,905

[45] Oct. 28, 1980

[54] STEREOPHONIC SYSTEM WITH DISCRETE BASS CHANNELS

[76] Inventors: Ronald J. Crum, 10208 28th Ave. SW., Seattle, Wash. 98146; Edward J. Churchill, 2835 SW. 102nd, Seattle, Wash. 98146

[21] Appl. No.: 935,029

[22] Filed: Aug. 18, 1978

Related U.S. Application Data

[63] Continuation of Ser. No. 803,674, Jun. 6, 1977, abandoned.

[51] Int. Cl.[2] ..... H04R 5/02; H04R 1/02

[52] U.S. Cl. ..... 179/1 GA; 179/1 E; 181/155

[58] Field of Search ..... 179/1 GA, 1 G, 1 E, 179/1 GP, 1 GQ; 181/152, 153, 155

[56] References Cited

U.S. PATENT DOCUMENTS

| | | | |
|---|---|---|---|
| D. 233,763 | 11/1974 | Crum | D26/5 |
| 1,586,659 | 6/1926 | Davis | 181/152 |
| 2,093,076 | 9/1937 | Engle | 179/1 |
| 2,179,840 | 11/1939 | Bucky | 179/1 G |
| 2,192,959 | 3/1940 | Ballard | 179/171 |
| 2,390,834 | 12/1945 | Hegener | 181/27 |
| 3,135,830 | 6/1964 | Starai | 179/1 |
| 3,478,167 | 11/1969 | Sorkin | 179/1 G |
| 3,657,480 | 4/1972 | Cheng | 179/1 D |
| 3,867,996 | 2/1975 | Lou | 181/155 |
| 3,947,635 | 3/1976 | Frankman | 179/1 GA |

FOREIGN PATENT DOCUMENTS

| | | | |
|---|---|---|---|
| 1077151 | 11/1954 | France | 181/155 |

OTHER PUBLICATIONS

Japanese Publication No. 21697/69, Sonny.

*Primary Examiner*—Douglas W. Olms
*Attorney, Agent, or Firm*—Delbert J. Barnard

[57] ABSTRACT

The stereophonic system includes a pair of right and left channel sub-bass converters in addition to the usual right and left channel main speakers. The main speakers are spaced apart from each other at one end of a space and the two sub-bass converters are spaced apart from each other at the opposite end of the space. The preferred position of a listener is generally between the two sub-bass converters. Each sub-bass converter comprises an inner housing defining a first chamber and a larger outer housing which is inverted over the inner housing, so that a second chamber is defined between the two housings, above and around the inner housing. The lower end of the inner housing serves as a floor contacting base. The outer housing has a 360° extending lower edge which is spaced above the level of said base, so that a generally downwardly directed, 360° extending outlet for the sub-bass converter, leading out from the second chamber, is formed near the base of the sub-bass converter. An upwardly directed vibrating cone type low frequency speaker is located within the inner housing. Such speaker has a peripheral mounting portion bordering a speaker opening in the top wall of the inner housing.

14 Claims, 8 Drawing Figures

STEREOPHONIC SYSTEM WITH DISCRETE BASS CHANNELS

This is a continuation of application Ser. No. 803,674, filed June 6, 1977, and now abandoned.

BACKGROUND OF THE INVENTION

1. Field of the Invention

This invention relates to stereophonic sound reproduction, and more particularly to a stereophonic sound system and method, and to a unique low frequency tranducer system for use therein.

2. Description of the Prior Art

As is well known, stereophonic type sound reproducing systems reproduce sound in such a manner as to convey a left to right distribution of the original sound source. Basically, in such systems, audio information obtained from a recording, tuner, or appropriate stereo source is processed into two separate channels and played through two separate loudspeaker systems spaced apart from each other at one end of a space, in such a manner as to reproduce left to right spatial distribution of the reproduced sound, primarily between the two separate loudspeakers, with the listener positioned at the other end of the space. The stereophonic systems in existence today produce excellent stereophonic effects at one end of a space, but fail to provide, in combination, sufficient sensations of depth, boundlessness, warmth and fullness normally associated with a concert hall situation, and insufficient, if any, sensation of height differentiation of sounds, without severe degradation of the intended stereophonic spatial image within the average living room listening environment. Stereophonic systems in existence today position the listener across a space from the reproduced performance and tend to exclude the listener from the space in which the reproduced performance is occuring, much like the way a standard motion picture projection system excludes the viewer from the space where the projected scene is taking place.

Basically, the present invention relates to a relatively simple way to place the listener in a more intimate relationship to the reproduced performance by creating an amphibinaural sound field, using auxiliary low frequency sound fields, ceiling and adjacent side wall reflections, and high definition directly radiated sound fields, that substantially surrounds the listener, an effect more like true binaural reproduction which includes the listener within the space of the occurring performance.

Examples of stereophonic sound reproducing systems which are in the patent literature, and which involves some manner of dividing out and separately amplifying low frequency sound are disclosed by U.S. Pat. No. 2,093,076, granted Sept. 14, 1937, to John F. Ingalls; by U.S. Pat. No. 2,179,840, granted Nov. 14, 1939, to Guestav Bucky; by U.S. Pat. No. 2,192,959, granted Mar. 12, 1940, to Randall C. Ballard; by U.S. Pat. No. 3,135,830, granted June 2, 1964, to Rudolph Starai; by U.S. Pat. No. 3,478,167, granted Nov. 11, 1969, to Morris Sorkin; and by U.S. Pat. No. 3,657,480, granted Apr. 18, 1972, to Theodore Cheng and James J. Hitt. The systems of these patents differ materially from the system of the present invention. However, the patents should be considered for the purpose of putting the invention into proper perspective relative to the prior art.

The subwoofer or sub-bass converter of the present invention reverses the direction of sound waves produced by a vibrating cone type speaker before releasing them. Examples of speakers in the patent literature which also involve a reversal in direction of sound waves are disclosed by U.S. Pat. No. 1,586,659, granted June 1, 1926, to John E. Davis, and by U.S. Pat. No. 2,390,834, granted Dec. 11, 1945, to Joseph Hegener.

SUMMARY OF THE INVENTION

According to an aspect of the present invention, an otherwise conventional stereo system is modified by taking low frequency portions of the sound information which is played over the right and left channel speakers and also playing them through separate right and left channel low frequency speakers, or subwoofers. The main right and left channel speakers are spaced apart from each other and are directed across a room or other space towards where the listener(s) and the two subwoofers are spaced apart from each other on opposite sides of the listener(s).

According to a further aspect of the invention, each subwoofer has a 360° outlet which is closely spaced above the floor and is directed generally downwardly towards the floor. Each subwoofer may comprise an inner housing having a closed bottom wall, closed side walls and a top wall which includes a speaker opening, together forming a first chamber. A larger outer housing, comprising a closed top wall, closed side walls, and an open lower end, is inverted over the inner housing. The inner and outer housings are supported in a spaced relationship, so that a second chamber is defined between the two housings, above and around the inner housing. The lower end of the inner housing serves as a floor contacting base. The outer housing has a 360° extending lower end which is spaced above the level of the base, so that a generally downwardly directed, 360° extending outlet for the cabinet is formed near the base, leading out from the second chamber. An upwardly directed vibrating cone type low frequency speaker or its equivalent is located within the housing. Such speaker includes a peripheral mounting portion which is positioned to border the speaker opening.

Preferably, the first and second chambers are substantially balanced accoustically.

These and other objects, advantages, and features of the present invention will be discussed below in connection with the description of the preferred embodiment.

BRIEF DESCRIPTION OF THE DRAWING

In the drawing like element designations refer to like parts, and.

DESCRIPTION OF THE PREFERRED EMBODIMENT

Figure 1:
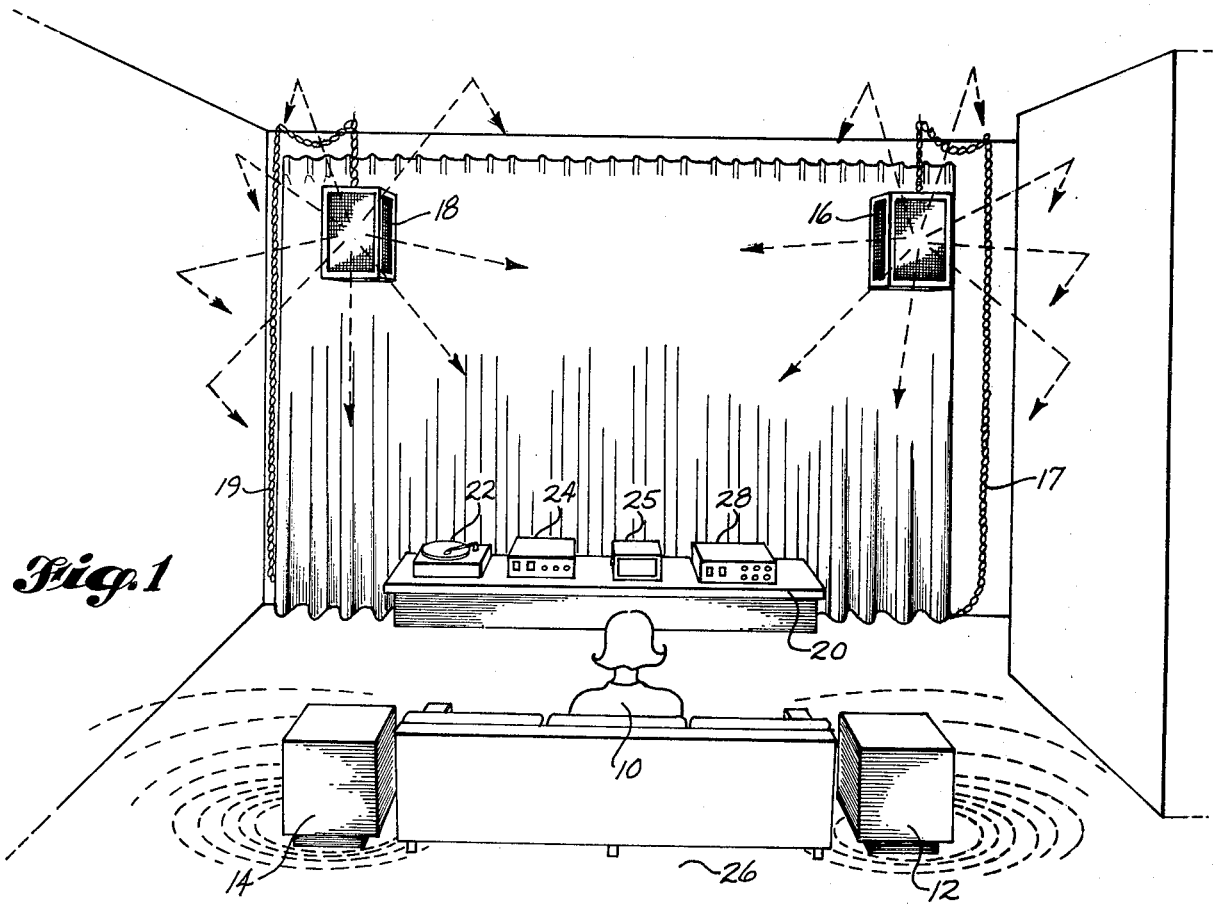
FIG. 1 is a pictorial view of a typical room arrangement of a stereo system utilizing my invention.
Figure 4:
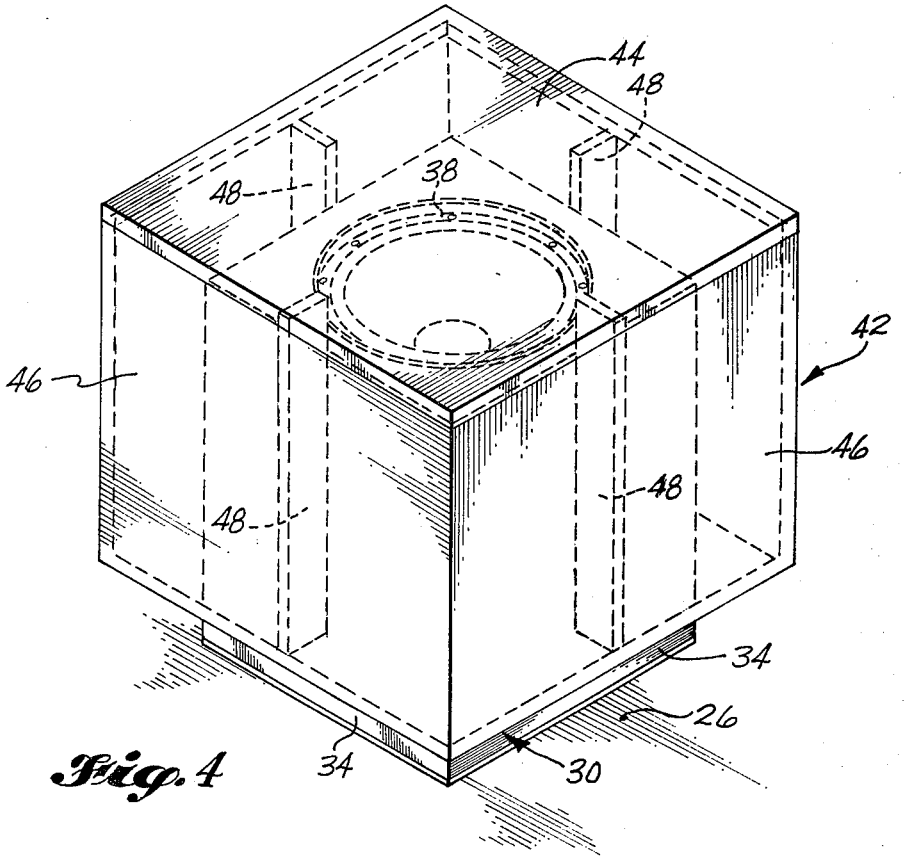
FIG. 4 is a pictorial view, taken from above and looking towards the top and two adjacent sides of a speaker unit embodying my invention.

Referring to FIG. 1, a listener 10 is shown positioned between two sub-bass converters or subwoofers 12, 14, located at one end of a room or other space in which the system is being operated. A pair of stereo speaker units 16, 18 are located at the opposite end of such space, to each side of the listener 10. The usual phonograph and/or tape deck assembly 22, an amplifier 24 and a preamplifier 25 are conveniently located. In FIG. 1 they are shown on a table 20 which is located between the two main speaker units 16, 18. The speaker units 16, 18 and the components 22, 24 are the usual basic components of a conventional stereo system and by themselves are not a part of my invention.

In order to obtain an amphibinaural effect, the main speakers 16, 18 are spaced apart from each other, at a preferred distance of about eight feet, at their end of the space, at a preferred off-axis listening elevation of five to six feet above floor level in a reasonably "live" room having a standard ceiling height of eight feet, at a preferred distance of two to three feet from adjacent side wall surfaces. The two sub-bass converters 12, 14 are spaced apart from each other, at a preferred distance of six to eight feet, at the opposite end of said space, at floor level, at a preferred distance of ten to fifteen feet from the main speakers 16, 18. The preferred position of a listener 10 is generally between the two sub-bass converters.

As will hereinafter be described in some detail, each sub-bass converter 16, 18 comprises an inner housing defining a first chamber and a larger chamber housing which is inverted over the inner housing, so that a second chamber is defined between the two housings, above and around the inner housing. The lower end of the inner housing serves as a floor contacting base. The outer housing has a 360 degree extending lower edge which is spaced above the level of said base so that a generally directed 360 degree extending aperture for the sub-bass converter, leading out from the second chamber, is formed near the base of the sub-bass converter. An upwardly directed vibrating low frequency driver is located within the inner housing. Such a transducer has a peripheral mounting portion bordering an opening in the top wall of the inner housing.

Each main speaker system 16, 18 may utilize a dome type high frequency transducer, a dome type mid-range transducer (dome types preferred due to superior polar response characteristics), a cone type low frequency transducer and an appropriate frequency dividing network to distribute the proper portion of the audio spectrum to the appropriate transducer. Each main satellite transducer system also may include a section of decorative link chain which serves as a means of suspending the transducer system from the ceiling to position it at the preferred elevation from floor level and serves as a means of adjusting elevation positioning. Rotational adjustment is also possible.

Figure 2:
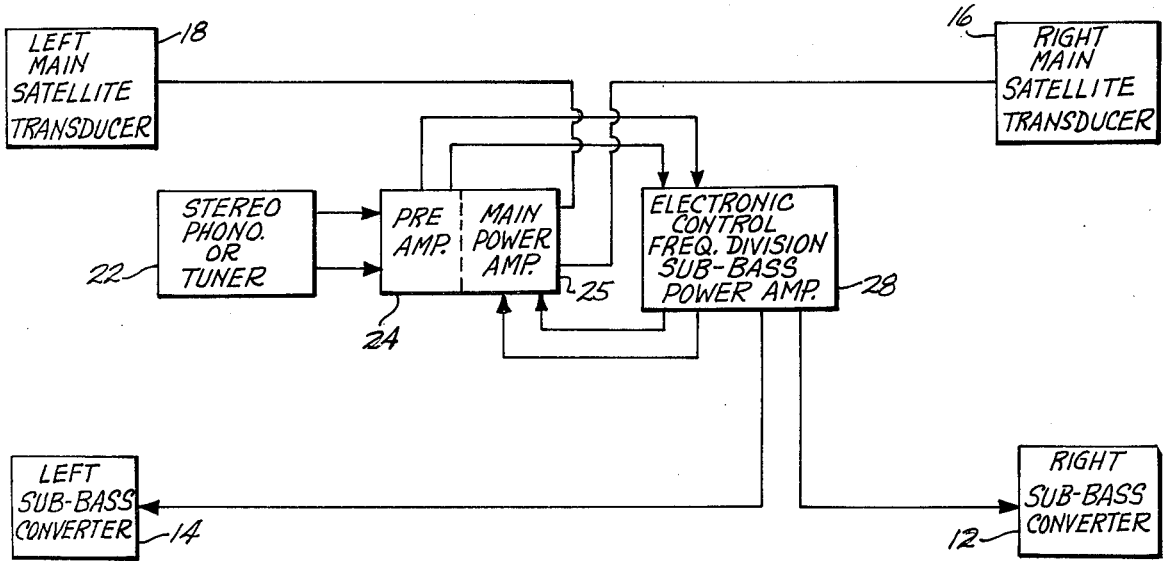
FIG. 2 is a block diagram of a preferred system.

Referring to FIG. 2, the electronic control, frequency division, and sub-bass power driver unit 28, designed for use within this present system, accepts the dual channel stereophonic inputs from a stereophonic preamplifier 24 or stereo receiver. Control R1 (FIG. 3) serves as a master volume control when the input is from an uncontrolled output, i.e. tape output etc., from either a stereo preamplifier or receiver. If the input is from a controlled preamplifier or receiver output, R1 merely serves as a master level control. Input buffer amplifier A1, is a unity gain buffer stage for all incoming frequencies. However, adjustment of R2, the LF Accent control, allows amplification of a portion of the low frequency spectrum, namely that portion considered low enough in frequency as to be non-directional, therefore providing gentle bass lift, if desired, at the output of A1. Main amplifier level control R3 is a linear level control and supplies a full spectrum drive signal for a remote main power amplifier connected to drive the main satellite transducers, whether it is an entirely separate basic power amplifier or the power amplifier section of a stereo receiver. The full spectrum composite output of A1 is applied to the input of an active filter stage, A2. This stage is essentially a unity gain stage for only a portion of the composite frequencies received from A1, namely the same low frequency portion of the spectrum controlled by R2. Frequencies above this portion are unwanted higher frequencies and are actively filtered and do not appear at the output of A2. LF intensity control R4 is arranged to provide an analog multiplication of the bass lift provided by LF Accent control R2, but operates only on that portion of the low frequency spectrum channeled to R5. Sub-bass level control R5 is also a linear control that controls the drive signal to the sub-bass power amplifier which only drives the sub-bass converters 12, 14. It is important to realize that the adjustment of R2 provides a subtle, low frequency accent, to both the main speaker units 16, 18 and the sub-bass converters, while adjustment of LF intensity control R4 provides a more intense degree of bass lift, if desired by the listener, to only the sub-bass converters 12, 14. The tandem arrangement of the control and frequency division circuitry is believed to be unique to this particular system and is extremely useful, especially at low listening levels. With these additional controls R1, R2, R3, R4 and R5, along with preamplifier or receiver controls, the listener can adjust the system for personal preferences for different recordings.

Figure 3:
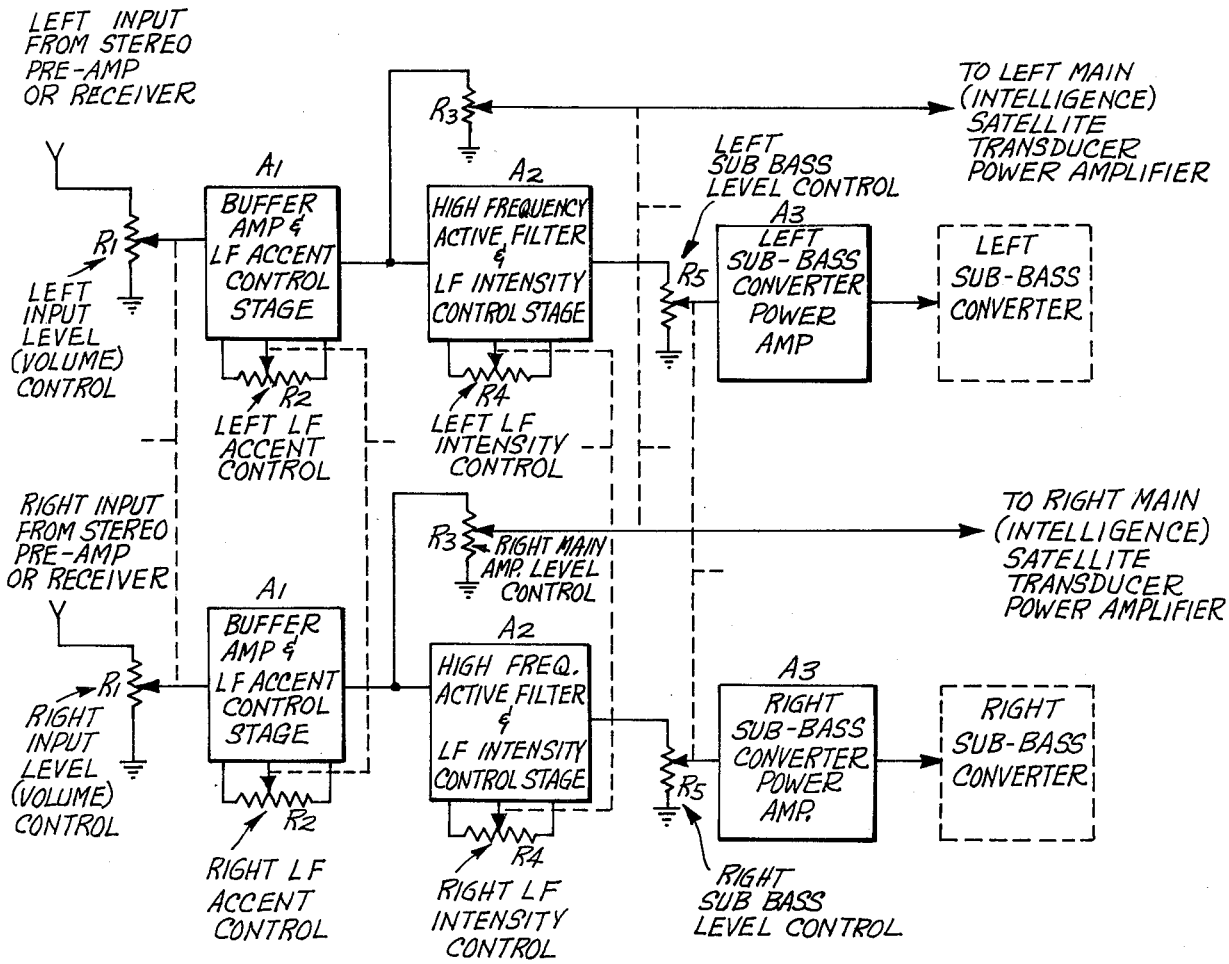
FIG. 3 is a schematic diagram of such system.

With this novel system and method/arrangement, previously described and illustrated in FIG. 1 and connected to otherwise standard stereophonic equipment in accordance with FIG. 3, an amphibinaural sound field is created that greatly enhances the enjoyment of a recorded performance. However, the technical advantages of this method and arrangement can only be realized in actual practice.

Suspending a speaker system from the ceiling is not in itself a new or novel idea, see U.S. Pat. No. Des. 233,763. Sub-woofers per se are not particularly a new or novel idea, nor is bi-amplification. However, the present sub-bass converter differs not only in construction, but in other benefical respects from known subwoofers. First, it serves to provide additional high frequency attenuation without the use of extra crossover network components and can be used with no external frequency division network whatsoever. This present design helps to minimize the potential of the sub-bass converter acting as a point source of directional information, especially in an arrangement locating the listener so close to the low frequency transducer systems. Another advantage to being able to locate the listener in this particular relationship to the sub-bass converters is that less power is required in the low frequency region of the spectrum to accomplish an awesome room filling effect. Since this design has a radiation aperture hidden from view, and no means of inspecting the actual driver unit, a listener tends to ignore them altogether and derive any lower frequency directional information, pertaining to the reproduced performance, from the directionality information presented by the main intelligence satellite transducers. Therefore, the sub-bass converters only become obvious by their absence when operated in accordance with a preferred method of operation.

Placement of the main intelligence satellite transducers or speakers 16, 18 as shown in FIG. 1, utilizes ceiling and adjacent side wall reflection characteristics, in conjunction with high definition, off-axis, direct radiation of all intelligence information, to position the stereo image "on stage" and enhance a listeners perception of sensations depth and boundless in addition to perceived sensations of vertical imaging (heighth differentiation of sounds). Placement of the sub-bass converters 12, 14 as shown in FIG. 1 contribute also to a listener's perceived sensations of vertical imaging while enhancing sensations of warmth, body and fullness of the reproduced performance without impinging upon the listener's perception of the intelligence information. To optomize the amphibinaural effect created by this present system method and arrangement the listener need only adjust those additional controls provided, adjust elevation and rotational position of the main satellite transducers, and adjust other controls available on any ancillary equipment for personal preference.

It is anticipated that the two subwoofers 12, 14 are identical. They will both now be described, but reference will be made only to subwoofer speaker 12.

Figure 5:
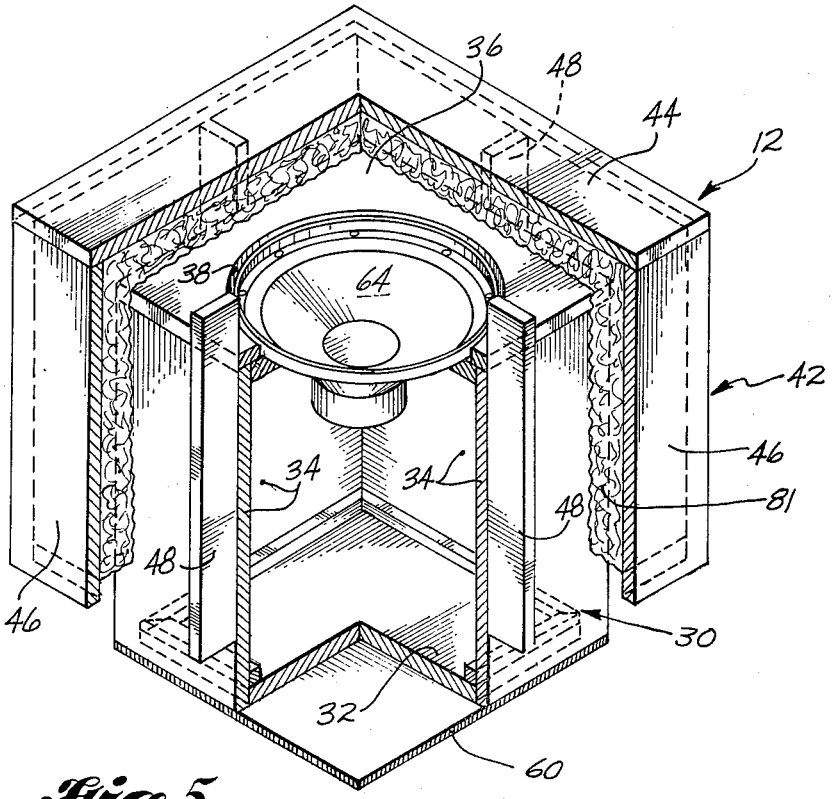
FIG. 5 is a view taken from the same aspect of FIG. 4, but with a foreground corner portion of the speaker unit cut away for the purpose of illustrating the interior of the speaker assembly.

As shown by FIGS. 2–5, the subwoofer 12 comprises an inner housing 30 having a closed bottom wall 32, closed side walls 34 and a top wall 36 which includes a relatively large diameter speaker opening 38. As best shown by FIGS. 3 and 5, the walls 32, 34 and 36 form a first or inner chamber 40.

A larger outer housing 42 is inverted over the inner housing 30. It comprises a closed top wall 44, closed side walls 46 and an open lower end.

As best shown by FIG. 5, the lower end of the inner housing 30 is also the lower end of the entire subwoofer 12 and it serves as a floor contacting base for the subwoofer 12.

The inner and outer housing 30, 42 are suitably held apart, such as by the use of connector members 48, for example. The illustrated embodiment comprises four connector members 48, one for each side of the subwoofer 12. Each member 48 is shown to be elongated and rectangular in shape. Each member 48 has an inner edge 50 (FIG. 4) which is in contact with a side wall 34 of the inner housing 30, and an opposite or outer edge 52 which is in contact with the inner side of the related side wall 46 of the outer housing 42. Each connector member 48 also includes an upper end portion 54 which projects upwardly above the top of wall 36 a predetermined amount. The lower ends 56 (FIG. 5) of connector members 48 preferably terminate about flush with, or at a level slightly above, the lower edges 58 of the outer side walls 46, so that they are hidden from view.

As illustrated, the lower edges 56 of the outer side walls 46 are spaced above the level of the bottom 60 of the floor contacting base 32. A generally cup-shaped space is formed partially above top wall 36, between it and top wall 44, and on the sides of the unit between the several pairs of side walls 34, 46. Such space is herein termed a second chamber 62. The connector members 48 actually divide the chamber 62 into four side parts. However, the chamber 62 will herein be referred to as a cup-like chamber which extends around and above the inner housing 30 because the connectors 48 collectively occupy only a small amount of the chamber space.

Figure 6:
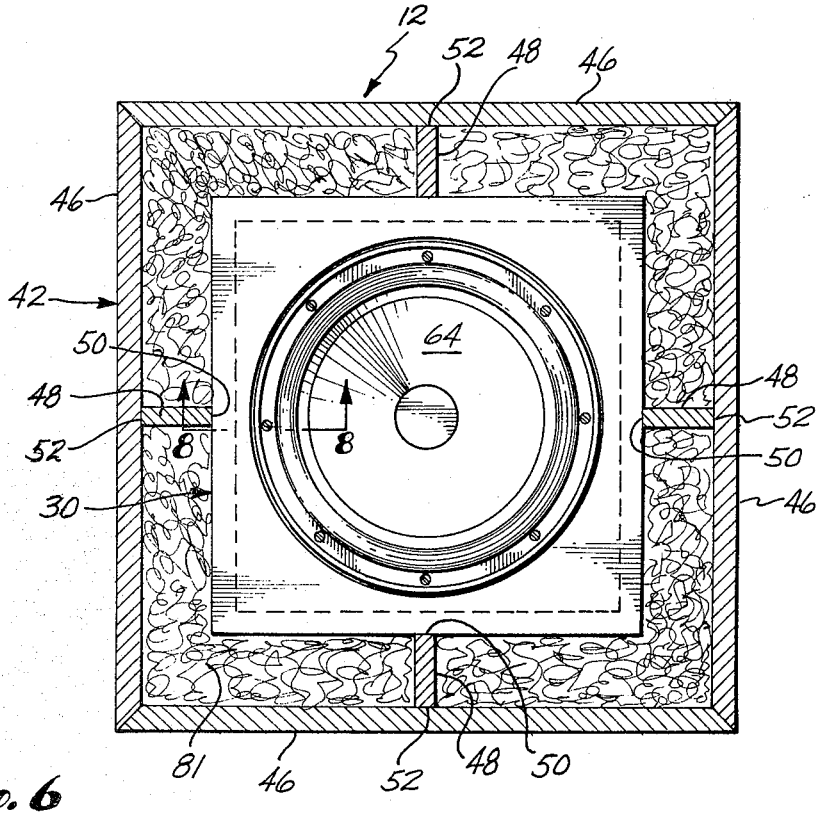
FIG. 6 is a horizontal sectional view taken substantially along line 6—6 of FIG. 7, and presenting a top plan view of the speaker and the inner housing.
Figure 7:
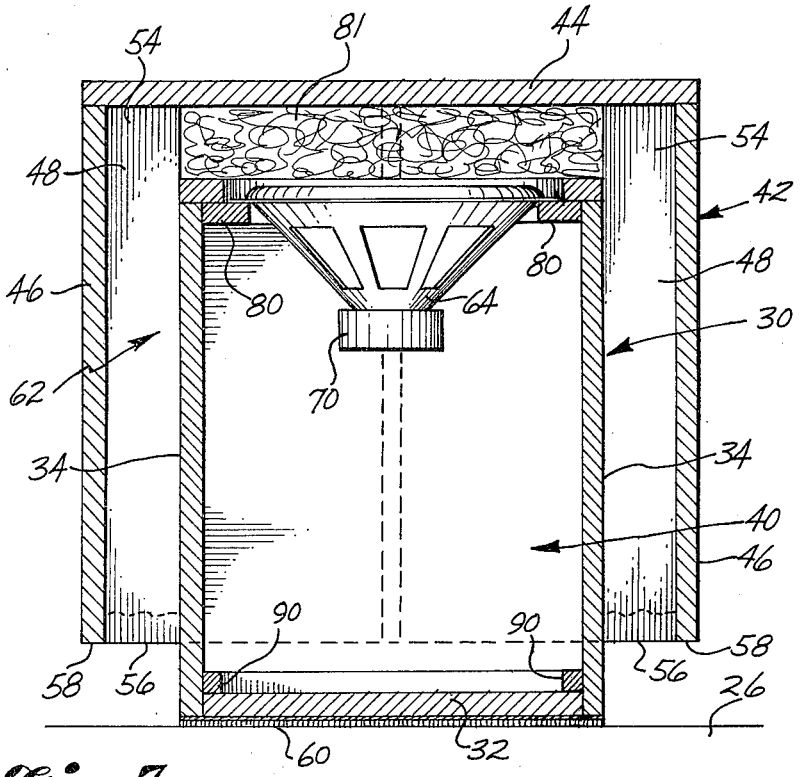
FIG. 7 is a vertical sectional view taken substantially along line 7—7 of FIG. 6, illustrating the manner in which the speaker is secured to the upper end of the inner housing, the relationship of the speaker cone to the space within the inner housing and the space between the two housings, and the location of the outlet for the speaker unit.
Figure 8:
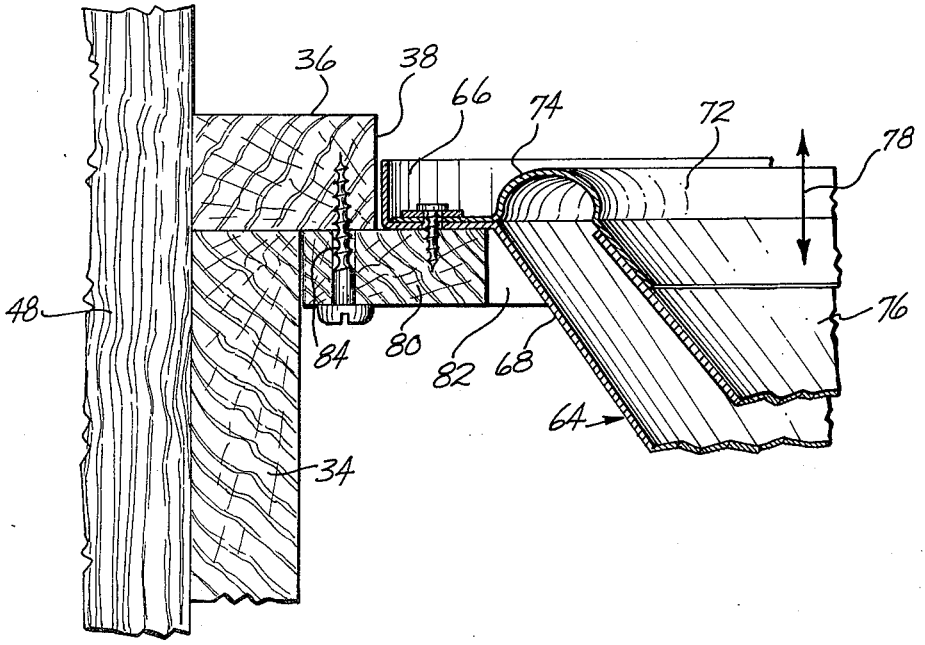
FIG. 8 is a fragmentary sectional view taken substantially along line 8—8 of FIG. 6.

An upwardly directed vibrating cone type low frequency speaker 64, or its equivalent, is mounted within the inner housing 30, with its peripheral mounting portion 66 bordering the speaker opening 38 (FIG. 6). The speaker 64 is by itself old. It may comprise a metal frame 68 having peripheral mounting ring 66 portion and a conical portion extending therefrom down to an apex which carries a large permanent magnet 70. An elastomeric ring 72, which includes a rounded ridge portion 74, is connected between the mounting rim 66 and the upper end of a vibrating speaker cone 76. The presence of the elastomeric connector 72 permits a considerable amount of movement of the cone 76 in the direction of the arrow 78, in response to the energy added to the cone 76 at the magnet ends thereof. As clearly shown by FIG. 7, the discharge of speaker cone 76 is perpendicular to top wall or pannel 44. As a result, a substantial portion of the energy bounces back to the top of the speaker cone 76. Owing to this arrangement, wall 44 may be termed a "loaded wall".

In the illustrated embodiment the peripheral mounting flange 66 is secured to a rectangular member 80 having a central opening 82 formed therein through which the main body of the speaker 64 extends. Member 80 is sized to be snugly received within the inner chamber 40. Member 80 is connected to the top wall 36, such as by screw type fasteners 84.

In preferred form, the chambers 40, 62 are accoustically balanced. This means that the chambers 40, 62 are properly sized so that the air resistance to movement of cone 76 is substantially equal on both sides of the cone 76. The chambers 40, 62 may be filled with a sound absorbing material 81, such as fiberglass mats which have been appropriately cut and fit together.

As best shown by FIGS. 3 and 5, the lower end of the second chamber 62 is open at a level above the floor contacting surface 60 of base 32, i.e. above the floor level 26. This opening extends a full 360° around the subwoofer 12 and is continuous except at the location of the connectors 48. However, as previously mentioned, the connectors 48 take up very little space within chamber 62 and for that reason can be disregarded when it comes to describing the shape of the chamber 62.

The opening from chamber 62 is the outlet of the subwoofer 12. It is generally downwardly directed, towards the floor 26, but is also somewhat laterally directed, so that the sound waves which are emitted travel outwardly over the floor 26.

With respect to the matter of assembly, the connectors 48 may be first secured to the side walls 34 of the inner housing 30. The member 80, with speaker 64 attached, may be secured to the top wall 60, with the resulting assembly being merely set down into the area between the upstanding portions of connectors 48 and on the upper edges of the side walls 34. Such assembly may be held in place by its own weight, or it may be firmly secured to the inner housing 30. In any event, the speaker 64 and the top wall 36 are both effectively secured to the rest of the inner housing 30. The outer housing 42 maybe oriented with its open end directed downwardly and be first placed above and then moved downwardly about the inner housing 30 until the upper end portions 52 of connectors 48 contact the top wall 44. Then, the outer housing 42 may in any suitable manner be secured to the inner housing 30. If a fibrous material 81 is used within the chambers 40, 62, it is inserted into such chambers at the appropriate time. The fibrous material 81 is placed within the first chamber 40 before the top wall 36, with speaker attached, is set into place and the fibrous material 81 within the second chamber 62 is set into place before the outer housing 42 is set into place.

In preferred form, the speaker 12 has the proportions of an end table and is intended to in fact function as an end table. In this regard, its maximum width dimension should measure between eighteen and twenty-five inches and its height dimension should also measure between eighteen and twenty-five inches.

As shown by FIG. 5, blocks or strips 90 may be secured to the lower inner portions of side walls 34, to serve as a stop for the bottom wall 32, and as a means for securing it to the rest of housing 30.

By way of typical and therefore non-limitive example, the walls of the inner housing 30 may be made from panel material which measures either five-eighths of an inch or three quarters of an inch thick. The distance from the bottom surface 60 up to the top of wall 36 may be about eighteen and five-eighths inches. The width dimension of the inner housing, on each side, may be about fifteen inches. The width dimension of the outer housing may be about twenty-one and one-half inches on each side. The outer housing may measure about eighteen inches in depth, from the top of wall 44 down to the lower edge 58. The wall portions of outer housing 42 are preferably three quarters of an inch in thickness. The speaker opening 38 may measure about twelve and one-half inches in diameter. The depth of a typical speaker 64 below its mounting board 80 may be about five inches.

In the above example, the volume of the first chamber 30 is about 1.9 cubic feet and the volume of the second chamber 62 is about 1.886 cubic feet. The area of the outlet, or port area, is about 160.145 square inches.

What is claimed is:

1. A stereo system and arrangement comprising:

a right channel main speaker unit;

a left channel main speaker unit spaced from said right channel speaker at one end of a space;

a right channel subwoofer;

a left channel subwoofer spaced from said right channel subwoofer at an opposite end of said space;

a listening position for a listener in said space generally between said subwoofers;

means providing audio sound information;

means for dividing said audio sound information into right and left stereo channels and directing said channels to the right and left main speaker units, respectively;

means for selecting a low frequency portion of the audio sound information that is delivered to the right channel main speaker unit and directing it to the right channel subwoofer, so that such low frequency audio sound information will be played both by the subwoofer and by the right channel main speaker unit, but the remaining right channel audio sound information will be played by the right channel main speaker unit alone;

means for selecting a low frequency portion of the audio sound information that is delivered to the left channel main speaker unit and directing it to the left channel subwoofer, so that such low frequency audio sound information will be played both by the subwoofer and by the left channel main speaker unit, but the remaining left channel audio information will be played by the left channel main speaker unit alone; and each said subwoofer comprising:

an inner housing comprising a closed bottom wall, closed side walls and a top wall including a speaker opening, together forming a first chamber which is closed except for the speaker outlet opening in the top wall;

a larger outer housing comprising a closed top wall, closed side walls, and an open lower end, said outer housing being inverted over the inner housing;

connector means between the inner and outer housing supporting them in a spaced relationship, so that a second chamber is defined between the two housings, above and around the inner housing;

said inner housing having a lower end which serves as a floor contacting base;

said outer housing having a 360° extending lower edge which is spaced above the level of said base, so that a generally downwardly directed, 360° extending outlet for the subwoofer, is formed near the base of the subwoofer, leading out from the second air chamber;

an upwardly directed vibrating diaphragm type low frequency speaker located within said inner housing, said speaker having a peripheral mounting portion bordering said speaker opening; and means connecting said peripheral mounting portion to the inner housing.

2. A stereo system according to claim 1, wherein the right and left channel main speaker units are elevated substantially above the level of said subwoofers.

3. A subwoofer for a stereo system, comprising:

an inner housing comprising a closed bottom wall, closed side walls and a top wall including a speaker opening, together forming a first chamber;

a large outer housing comprising a closed top wall, closed side walls, and an open lower end, said outer housing being inverted over the inner housing;

connector means between the inner and outer housing supporting them in a spaced relationship, so that a cup-shaped second chamber is defined between the two housings, above the top wall of the inner housing and around the side walls of the inner housing;

said inner housing having a lower end which serves as a floor contacting base and a vertical side wall surface;

said outer housing having a 360° extending lower edge which is spaced vertically above the level of said base and horizontally outwardly from the vertical side wall surface of the inner housing, so that a downwardly directed, 360° extending outlet for the subwoofer, is formed near the base of the subwoofer, leading out from the second chamber downwardly towards the floor;

an upwardly directed vibrating cone type low frequency speaker located within said inner housing, said speaker having a peripheral mounting portion bordering said speaker opening;

said closed top wall of the outer housing presenting a generally flat surface facing towards the speaker which rebounds the energy emitted from the speaker back to such speaker; and means connecting said peripheral mounting portion to the inner housing.

4. A subwoofer according to claim 3, wherein the height of the subwoofer from the bottom of said floor contacting base up to the top surface of the top wall of the outer housing measures between eighteen and twenty-five inches.

5. A subwoofer according to claim 4, wherein the maximum width dimension of the subwoofer also measures between eighteen and twenty-five inches.

6. A subwoofer for a stereo system, comprising:

an inner housing comprising a closed bottom wall, closed side walls and a top wall including a speaker opening, together forming a first chamber;

a large outer housing comprising a closed top wall, closed side walls, and an open lower end, said outer housing being inverted over the inner housing;

connector means between the inner and outer housing supporting them in a spaced relationship, so that a second chamber is defined between the two housing, above and around the inner housing;

said connector means comprising a plurality of vertically elongated connector members spaced about the subwoofer, and each including an inner portion in contact with a side wall portion of the outer housing, an upper end portion which projects upwardly above the top wall of the inner housing and makes contact with the top wall of the outer housing, and lower end which terminates above the lower edge of the outer housing;

said inner housing having a lower end which serves as a floor contacting base;

said outer housing having 360° extending lower edge which is spaced above the level of said base, so that a generally downwardly directed, 360° extending outlet for the subwoofer, is formed near the base of the subwoofer, leading out from the second chamber;

an upwardly directed vibrating cone type low frequency speaker located within said inner housing, said speaker having a peripheral mounting portion bordering said speaker opening; and means connecting said peripheral mounting portion to the inner housing.

7. A subwoofer for a stereo system, comprising:

an inner housing comprising a closed bottom wall, closed side walls and a top wall including a speaker opening, together forming a first chamber;

a larger outer housing comprising a closed top wall, closed side walls, and an open lower end, said outer housing being inverted over the inner housing;

connector means between the inner and outer housing supporting them in a spaced relationship, so that a second chamber is defined between the two housing, above and around the inner housing;

said inner housing having a lower end which serves as a floor contacting base;

said outer housing having a 360° extending lower edge which is spaced above the level of said base, so that a generally downwardly directed, 360° extending outlet for the subwoofer, is formed near the base of the subwoofer, leading out from the second chamber;

an upwardly directed vibrating cone type low frequency speaker having a peripheral mounting portion bordering said speaker opening; means connecting said peripheral mounting portion to the inner housing; and said first and second chambers being substantially balanced accoustically.

8. A subwoofer, for a stereo system, comprising:

an inner housing comprising a closed bottom wall, closed side walls and a top wall including a speaker opening, together forming a first chamber;

a large outer housing comprising a closed top wall, closed side walls, and an open lower end, said outer housing being inverted over the inner housing;

connector means between the inner and outer housing supporting them in a spaced relationship, so that a second chamber is defined between the two housing, above and around the inner housing;

said inner housing having a lower end which serves as a floor contacting base;

said outer housing having a 360° extending lower edge which is spaced above the level of said base, so that a generally downwardly directed, 360° extending outlet for the subwoofer, is formed near the base of the subwoofer, leading out from the second chamber;

an upwardly directed vibrating cone type low frequency speaker located within said inner housing, said speaker having a peripheral mounting portion bordering said speaker opening;

means connecting said peripheral mounting portion to the inner housing; and a sound absorbing material within both said chambers.

9. A subwoofer for a stereo system comprising:

an inner housing comprising a closed bottom wall, closed side walls and a top wall including a speaker opening, together forming a first chamber;

a larger outer housing comprising a closed top wall, closed side walls, and an open lower end, said outer housing being inverted over the inner housing;

connector means between the inner and the outer housing supporting them in a spaced relationship, so that a second chamber is defined between the two housing, above and around the inner housing;

said inner housing having a lower end which serves as a floor contacting base;

said outer housing having a 360° extending lower edge which is spaced above the level of said base, so that a generally downwardly directed, 360° extending outlet for the subwoofer, is formed near the base of the subwoofer, leading out from the second chamber;

an upwardly directed vibrating cone type low frequency speaker located within said inner housing, said speaker having a peripheral mounting portion bordering said speaker opening;

means connecting said peripheral mounting portion to the inner housing;

wherein said connector means comprises a plurality of vertically elongated connector members spaced about the subwoofer, each including an inner portion in contact with a side wall of the inner housing, an outer portion in contact with a side wall portion of the outer housing, an upper end portion which projects upwardly above the top wall of the inner housing and makes contact with the top wall of the outer housing, and a lower end which terminates above the level of the lower edge of the outer housing; and wherein the first and second chambers are substantially balanced accoustically.

10. A stereo system comprising:

a full spectrum right channel main speaker unit;

a full spectrum left channel main speaker unit;

a right channel subwoofer within a first cabinet;

a left channel subwoofer within a second cabinet that is spaced from said first cabinet, so that the two subwoofers are accoustically separated;

means providing audio sound information;

means for dividing said audio sound information into full spectrum right and left stereo channels and directing said channels to the right and left main speaker units, respectively;

means for selecting a low frequency portion of the audio sound information that is delivered to the right channel subwoofer, so that such low frequency audio sound information will be played both by the subwoofer and by the left channel main speaker unit, and the remaining left channel audio sound information will be played by the left channel main speaker unit but not by the right channel subwoofer.

11. A stereo system according to claim 10, wherein each subwoofer comprises:

an inner housing comprising a closed bottom wall, closed side walls and a top wall including a speaker opening, together forming a first chamber;

a large outer housing comprising a closed top wall, closed side walls, and an open lower end, said outer housing being inverted over the inner housing;

connector means between the inner and outer housing supporting them in a spaced relationship, so that a second chamber is defined between the two housings, above and around the inner housing;

said inner housing having a lower end which serves as a floor contacting base;

said outer housing having a 360° extending lower edge which is spaced above the level of said base, so that a generally downwardly directed, 360° extending outlet for the subwoofer, is formed near the base of the subwoofer, leading out from the second chamber;

an upwardly directed vibrating cone type low frequency speaker located within said inner housing, said speaker having a peripheral mounting portion bordering said speaker opening; and means connecting said peripheral mounting portion to the inner housing.

12. A stereophonic sound reproducing method, comprising:

dividing recorded stereophonic audio information into two full spectrum channels; amplifying each full spectrum information and directing it to a main speaker means for such channel; sand the improvement comprising;

directing a duplicate low frequency portion only of each channel information to a subwoofer speaker for such channel which is physically spaced apart from the subwoofer for the other channel in a separate cabinet, and which is accoustically isolated from the subwoofer for the other channel, and with said subwoofers being spaced generally across a listening space from the two main channel speakers.

13. The method of claim 12 further comprising directing the sound waves from each subwoofer downwardly and generally perpendicularly towards the floor and generally omni directional outwardly over the floor.

14. The method of claim 13, further comprising directing the full spectrum sound waves from each main speaker means generally laterally outwardly at a level substantially and exclusively above the subwoofer speakers.

* * * * *